US006106168A

United States Patent [19]

Nishimoto et al.

[11] Patent Number: 6,106,168

[45] Date of Patent: Aug. 22, 2000

[54] AUTOMATIC DEVELOPING APPARATUS

[75] Inventors: Youji Nishimoto, Wakayama; Yasuto Kimura, Wakayama-ken, both of Japan

[73] Assignee: Noritsu Koki Co., Ltd., Wakayama, Japan

[21] Appl. No.: 09/244,571

[22] Filed: Feb. 10, 1999

[30] Foreign Application Priority Data

Feb. 10, 1998 [JP] Japan ..... 10-028975

[51] Int. Cl.[7] ..... G03D 3/08

[52] U.S. Cl. ..... 396/617; 396/620; 396/622

[58] Field of Search ..... 396/617, 620, 396/622

[56] References Cited

U.S. PATENT DOCUMENTS 4,903,064 2/1990 Kogane et al. ..... 396/622
5,134,430 7/1992 Koizumi ..... 354/320

FOREIGN PATENT DOCUMENTS 0608859 8/1994 European Pat. Off. .
0622676 11/1994 European Pat. Off. .
953584 3/1964 United Kingdom .
962798 7/1964 United Kingdom .

*Primary Examiner*—Alan A. Mathews
*Attorney, Agent, or Firm*—Smith Patent Office

[57] ABSTRACT

An automatic developing apparatus which transports film while preventing treatment liquid from being passed up onto gears and the like located above the surface of the treatment liquid and which prevents treatment liquid from being oxidized or decreasing in quantity. A cylindrical shaft having an axis of rotation normal to a liquid surface of the treatment liquid is positioned so as to cross the liquid surface in order to transmit torque from above the liquid surface to below the liquid surface via a shaft. Since the shaft is rotated about the axis of rotation normal to the liquid surface, the treatment liquid in contact with the shaft is left in contact therewith at a specified height, thereby eliminating the likelihood that the treatment liquid is passed up onto bevel gears, etc. located above the liquid surface via the shaft. Further, the rotation of the shaft about its axis of rotation does not cause the treatment liquid near the liquid surface to be scooped up. This prevents the treatment liquid from being oxidized by mixing with air.

10 Claims, 6 Drawing Sheets

AUTOMATIC DEVELOPING APPARATUS

BACKGROUND OF THE INVENTION

1. Field of the Invention

The present invention relates to an automatic developing apparatus in which a film transport unit provided with film transport rollers is sunk in a treatment tank containing treatment liquid used for developing film or a similar photosensitive material. In particular, the present invention relates to an automatic developing apparatus where torque is transmitted from outside of the treatment tank to the film transport rollers through the liquid surface in the treatment tank.

2. Discussion of the Related Art

Automatic developing apparatus generally include a plurality of treatment tanks 52 containing treatment liquids 51 which are liquid agents such as developer, bleaching liquid and fixer, for example, as shown in FIG. 4. Transport units (hereinafter, "rack") 53 containing a plurality of transport rollers for transporting a photosensitive material such as film are sunk in the respective treatment tanks 52. In this way, the film can be developed by being immersed in the respective treatment liquids 51 while being transported through the respective treatment tanks 52. The film, developed by passage through the respective treatment tanks 52, is then transported to a drying assembly (not shown) to be dried and discharged from the apparatus.

The aforementioned plurality of transport rollers of the rack 53 include a pair of feed rollers 54*a*, 54*b*, large-diameter rollers 55*a*, 55*b*, 55*c*, first small-diameter rollers 56*a*, 56*b*, 56*c*, second small-diameter rollers 57*a*, 57*d*, 57*c*, and reverse rollers (not shown). These rollers are provided so that the axis of rotations thereof all are along the widthwise direction of the film. The reverse rollers are provided at the bottom end of the rack 53 without being held in contact with any other roller, and the transport direction of the film being transported is reversed by being moved along the circumferential surface of the reverse rollers.

The feed rollers 54*a*, 54*b* introduce the film into the treatment tank 52 and are positioned near a film inlet so as to face each other.

The large-diameter roller 55*a* is provided in an inner upper portion of the rack 53 such that a portion of its circumferential surface crosses the liquid surface L of the treatment liquid 51 in the treatment tank 52. The large-diameter rollers 55*b*, 55*c*, are provided in this order in a downward direction from the large-diameter roller 55*a* so that the interval between successive rollers (including the interval between the large-diameter rollers 55*a* and 55*b*) are substantially equal, and are completely immersed in the treatment liquid 51.

The first small-diameter rollers 56*a*, 56*b*, 56*c*, are positioned to face the large-diameter rollers 55*a*, 55*b*, 55*c*, so that the film introduced by the pair of feed rollers 54*a*, 54*b* can be transported by the rotation of the respective pairs of the large-diameter and small-diameter rollers while being tightly held.

The second small-diameter rollers 57*a*, 57*b*, 57*c*, are positioned to face the large-diameter rollers 55*a*, 55*b* 55*c*, at the side opposite from the first small-diameter rollers 56*a*, 56*b*, 56*c*, so that the film having its transport direction reversed by the reverse rollers can be transported by the rotation of the respective pairs of the large-diameter and small-diameter rollers while being tightly held.

Torque imparted to these transport rollers is transmitted from a drive source (not shown) outside the treatment tank 52 via gears and spur gears provided in the treatment tank 52. Hereinafter, the principle of rotating the respective transport rollers is described with reference to FIGS. 4 and 5.

The large-diameter rollers 55*a*, 55*b*, 55*c*, the first small-diameter rollers 56*a*, 56*b*, 56*c*, and the second small-diameter rollers 57*a*, 57*b*, 57*c*, shown in FIG. 4 are connected with first spur gears 65*a*, 65*b*, 65*c*, second spur gears 66*a*, 66*b*, 66*c*, and the third spur gears 67*a*, 67*b*, 67*c*, while sharing the same rotatable shafts. The first spur gears 65*a*, 65*b*, 65*c*, are in mesh with the second spur gears 66*a*, 66*b*, 66*c*, and also with the third spur gears 67*a*, 67*b*, 67*c*, respectively.

The first spur gear 65*a* integrally positioned with the large-diameter roller 55*a* is positioned such that a portion of the teeth on its circumferential surface crosses the liquid surface L of the treatment liquid 51 in the treatment tank 52 when the rack 53 is set in the treatment tank 52. Further, the reverse rollers are connected to the first spur gear located in the bottommost position in the rack 53 while sharing the same rotatable shaft.

Fourth spur gears 68*a*, 68b, 68*c*, are placed between the first spur gears 65*a* and 65*b* and between the first spur gears 65*b* and 65*c*, such that each is in mesh with the corresponding pair of the first spur gears. The first spur gear 65*a* located in the uppermost position in the rack 53 is in mesh with a fifth spur gear 70 provided coaxially with a gear 69, to which torque is transmitted from the drive source at the side opposite from the engaging portion with the fourth spur gear 68*a*.

It is noted that spur gears provided coaxially with feed rollers 54*a*, 54*b* (see FIG. 4) are not illustrated. However, the torque from the drive source is transmitted to the feed rollers 54*a*, 54*b* at least via, e.g. the fifth spur gear 70 so that the feed rollers 54*a*, 54*b* are rotated to introduce the film between the large-diameter roller 55*a* and the first small-diameter roller 56*a*.

In the above construction, if torque from the drive source is used to simultaneously rotate the gear 69 and the fifth spur gear 70 in, e.g. a direction E of FIG. 5, the first spur gear 65*a* in mesh with the fifth spur gear 70 is rotated in a direction F which is opposite from the direction E. The second spur gear 66*a*, the third spur gear 67*a* and the fourth spur gear 68*a* which are in mesh with the fifth spur gear 65*a* are rotated in the direction E. The first spur gear 65*b* in mesh with the fourth spur gear 68*a* is rotated in the direction F by the rotation of the fourth spur gear 68*a* in the direction E, with the result that the second spur gear 66*b*, the third spur gear 67*b* and the fourth spur gear 68*a* which are in mesh with the first spur gear 65*b* are rotated in the direction E.

Thereafter, the large-diameter rollers 55*a*, 55*b*, 55*c*, provided coaxially with the first spur gears 65*a*, 65*b*, 65*c*, are all rotated in the direction F by the rotation of all the first spur gears 65*a*, 65*b*, 65*c*, in the direction F. On the other hand, the first small-diameter rollers 56*a*, 56*b*, 56*c*, and the second small-diameter rollers 57*a*, 57*b*, 57*c*, are all rotated in the direction E by the rotation of all the second spur gears 66*a*, 66*b*, 66*c* and all the third spur gears 67*a*, 67*b*, 67*c*, in the direction E.

Accordingly, as shown in FIG. 4, the film is passed through the film inlet (not shown) and passed between the feed rollers 54*a*, 54*b*. Then the film is transported to the lower side while being successively passed between the large-diameter roller 55*a* and the first small-diameter roller 56*a* and between the large-diameter roller 55*b* and the first small-diameter roller 56*b*, by the rotation of the large-diameter rollers 55 and the first small-diameter rollers 56. After the transport direction of the film is reversed by the reverse rollers, the film is transported upward from the lower side while passing between the corresponding pairs of the large-diameter rollers 55 and the second small-diameter rollers 57 by the rotation of the large-diameter rollers 55 and the second small-diameter rollers 57. Thereafter, the film is transported to the next treatment tank 52 while passing between the large-diameter roller 55*a* and second small-diameter roller 57*a*. In other words, the film passes along a film transport path indicated by P in FIG. 4.

FIG. 6 is a cross sectional view along line A—A of FIG. 4. As shown in FIG. 6, slit-shaped outlets 58 are formed in positions corresponding to the film transport path inside the rack 53, and the treatment liquid 51 is placed into the treatment tank 52 through the outlets 58.

In a conventional developing apparatus, a part of the irregularity on the circumferential surface of the first spur gear 65*a* having an axis of rotation in parallel with the liquid surface L of the treatment liquid 51 crosses the liquid surface L of the treatment liquid 51 in the treatment tank 52. Accordingly, while the first spur gear 65*a* is rotated, the treatment liquid 51 is scooped up by the teeth (projections) of the first spur gear 65*a* and, therefore, it is either directly deposited on the teeth or it falls after being scooped up, thereby mixing with the treatment liquid 51 in the treatment tank 52.

Here, in the case of deposition on the teeth, the scooped treatment liquid 51 also passes onto the second spur gear 66*a*, the third spur gear 67*a* and the fifth spur gear 70 in mesh with the first spur gear 65*a* and is solidified on the circumferential surfaces of these spur gears. This results in added weight acting on the torque transmission from the drive source and unsatisfactory torque transmission, thereby hindering film transport.

On the other hand, in the case where the liquid falls back into the tank, since the treatment liquid 51 is frequently brought into contact with air by being scooped up, oxidation of the treatment liquid 51 is promoted. This oxidation reduces the usefulness of the treatment liquid 51. In addition, evaporation of the liquid increases, thereby decreasing the amount of treatment liquid 51 which is predetermined in accordance with required specifications. As a result, satisfactory development cannot always be achieved.

SUMMARY OF THE INVENTION

The present invention was developed in view of the above and other problems. Accordingly, an object of the present invention is to provide an automatic developing apparatus in which torque can be transmitted to the respective transport rollers without scooping up the surface of a treatment liquid, so that the film can be satisfactorily transported while preventing the treatment liquid from being passed onto other members. Thus, development in accordance with the specifications of the treatment liquid can be reliably performed by reducing oxidation of the treatment liquid. In addition, the amount of treatment liquid can be decreased since liquid loss is minimized.

The invention is directed to an automatic developing apparatus comprising a treatment tank for holding a treatment liquid having a liquid surface and for developing a photosensitive material, and a transport unit comprising a plurality of transport rollers for transporting the photosensitive material, wherein the photosensitive material is developed by sinking the transport unit in the treatment tank to immerse the photosensitive material in the treatment liquid. The apparatus also includes a torque transmitting means for transmitting torque from outside of the treatment tank to the respective transport rollers through the liquid surface in the treatment tank, wherein said torque transmitting means comprises a shaft-shaped transmitting portion having an axis of rotation normal to the liquid surface, wherein said shaft-shaped transmitting portion is positioned so as to cross the liquid surface, and a remaining portion of said torque transmitting means is positioned so as not to cross the liquid surface.

With this construction, torque provided from outside of the treatment tank is transmitted to the respective transport rollers of the transport unit sunk in the treatment tank, thereby driving the respective transport rollers to transport the photosensitive material into the treatment tank.

The torque transmitting means is comprised of a shaft-shaped transmitting portion which has an axis of rotation normal to the liquid surface and is positioned so as to cross the liquid surface. The remaining portion is positioned so as not to cross the liquid surface. The torque is transmitted from above the liquid surface to below the liquid surface via the shaft-shaped transmitting portion. In other words, in the above construction, only the shaft-shaped transmitting portion is in contact with the liquid surface of the treatment liquid, but the portion other than the shaft-shaped transmitting portion is out of contact with the liquid surface.

Here, since the shaft-shaped transmitting portion is rotated about an axis of rotation normal to the liquid surface, the treatment liquid is left in contact with this transmitting portion at a specified height. Accordingly, the rotation of the shaft-shaped transmitting portion does not cause the treatment liquid to be passed onto the torque transmitting means located above the liquid surface via the shaft-shaped transmitting portion. Therefore, there is no likelihood that the drive of the torque transmitting means is hindered by solidification of the treatment liquid thereon. Thus, according to the above construction, the torque can be smoothly transmitted from outside of the treatment tank to the respective transport rollers via the liquid surface of the treatment liquid without depositing superfluous material. This results in satisfactory transportation of the photosensitive material.

Further, since the shaft-shaped transmitting portion is rotated about an axis of rotation normal to the liquid surface, the treatment liquid near the liquid surface will not be scooped up during the rotation of the shaft-shaped transmitting portion. This limits the reaction of the treatment liquid with air and, as a result, considerably prevents oxidation and evaporation of the treatment liquid. Therefore, according to the above construction, a reduction in the function of the treatment liquid and a loss in the quantity of the treatment liquid can be dramatically suppressed. As a result, satisfactory development in accordance with the specifications of the treatment liquid can be achieved.

Preferably, the shaft-shaped transmitting portion has a cylindrical shape. By making the shaft-shaped transmitting portion cylindrical, the cross section thereof in the liquid surface of the treatment liquid does not change regardless of whether it is stationary or rotating. Accordingly, as compared to the case where the shaft-shaped transmitting portion is in the shape of, e.g. a rectangular prism, the liquid surface is unlikely to be rippled and, as a result, there is little likelihood than the treatment liquid will be mixed with air by the rotation of the shaft-shaped transmitting portion. Therefore, when the shaft-shaped transmitting portion has a cylindrical shape, the oxidation and evaporation of the treatment liquid can be considerably lessened as compared to any other shape. As a result, the treatment liquid can be used for a longer period of time while avoiding a reduction in its quality.

Preferably, the torque transmitting means further comprises a first rotatable shaft above the liquid surface and at least one second rotatable shaft below the liquid surface. The first and second shafts are in parallel with the liquid surface, and each is connected to the shaft-shaped transmitting portion by torque transmission gears.

These and other objects, features and advantages of the present invention will become more apparent upon a reading of the following detailed description and accompanying drawings.

DETAILED DESCRIPTION OF THE PREFERRED EMBODIMENTS

An automatic developing apparatus according to the invention is provided with a treatment tank 2 containing treatment liquid 1 used for developing film or like photosensitive material, and a rack 3 (transport unit) including a plurality of transport rollers for transporting the film. The rack 3 is sunk in the treatment tank 2 to immerse the film in the treatment liquid 1 in order to develop the film.

The rack 3 includes a first transport path W1 for transmitting film having a width of 24 mm in accordance with the APS (advanced photo system), a second transport path W2 for transporting a 135 size film having a width of 35 mm and the aforementioned plurality of transport rollers for the respective treatment paths. The first and second transport paths W1, W2 run parallel to each other, so that two kinds of films having different widths can be simultaneously developed. Hereinafter, the respective transport rollers provided in the respective transport paths are described.

Figure 1:
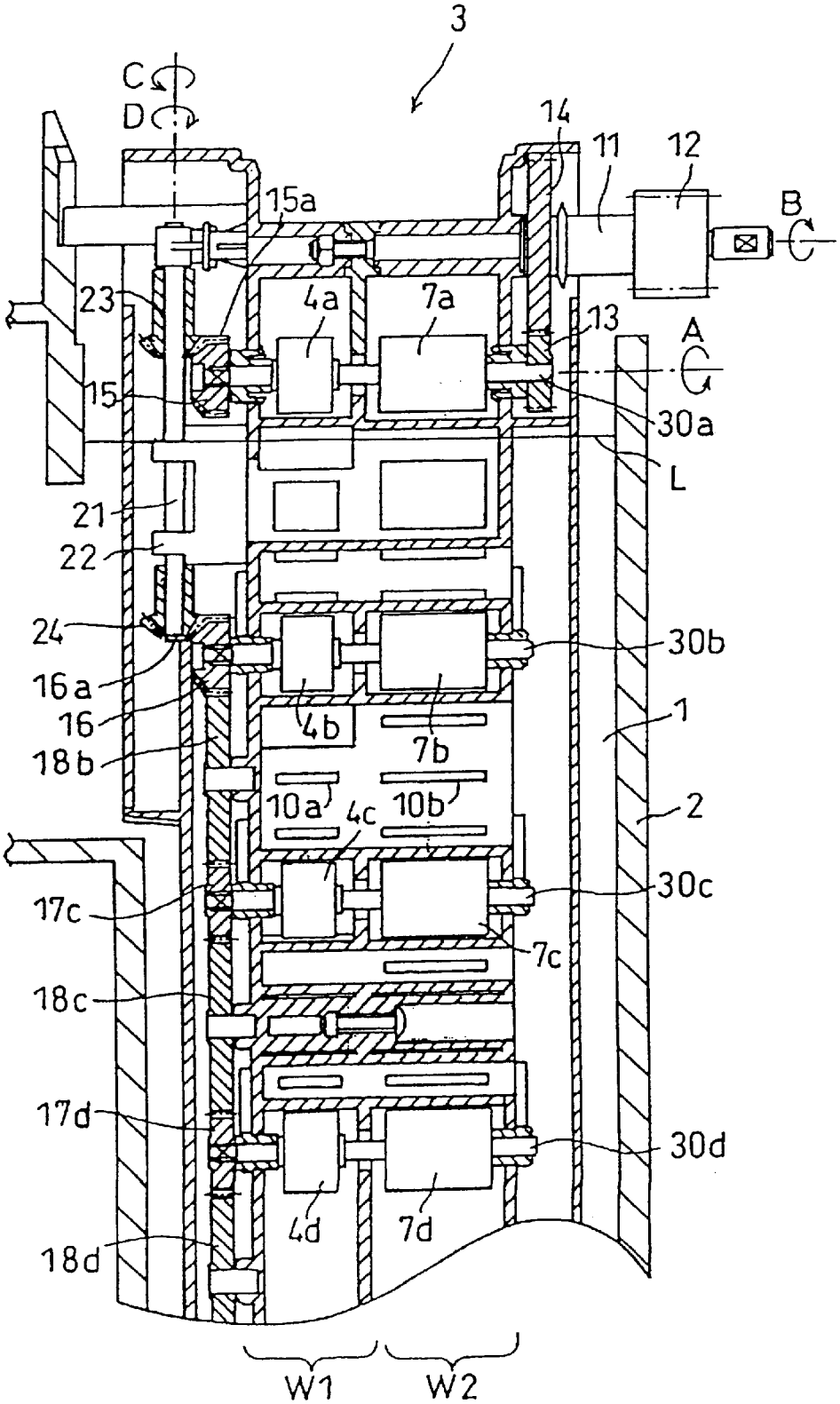
FIG. 1 is a cross sectional view along line A—A of FIG. 2 showing the schematic inner construction of a rack of an automatic developing apparatus according to the invention.
Figure 2:
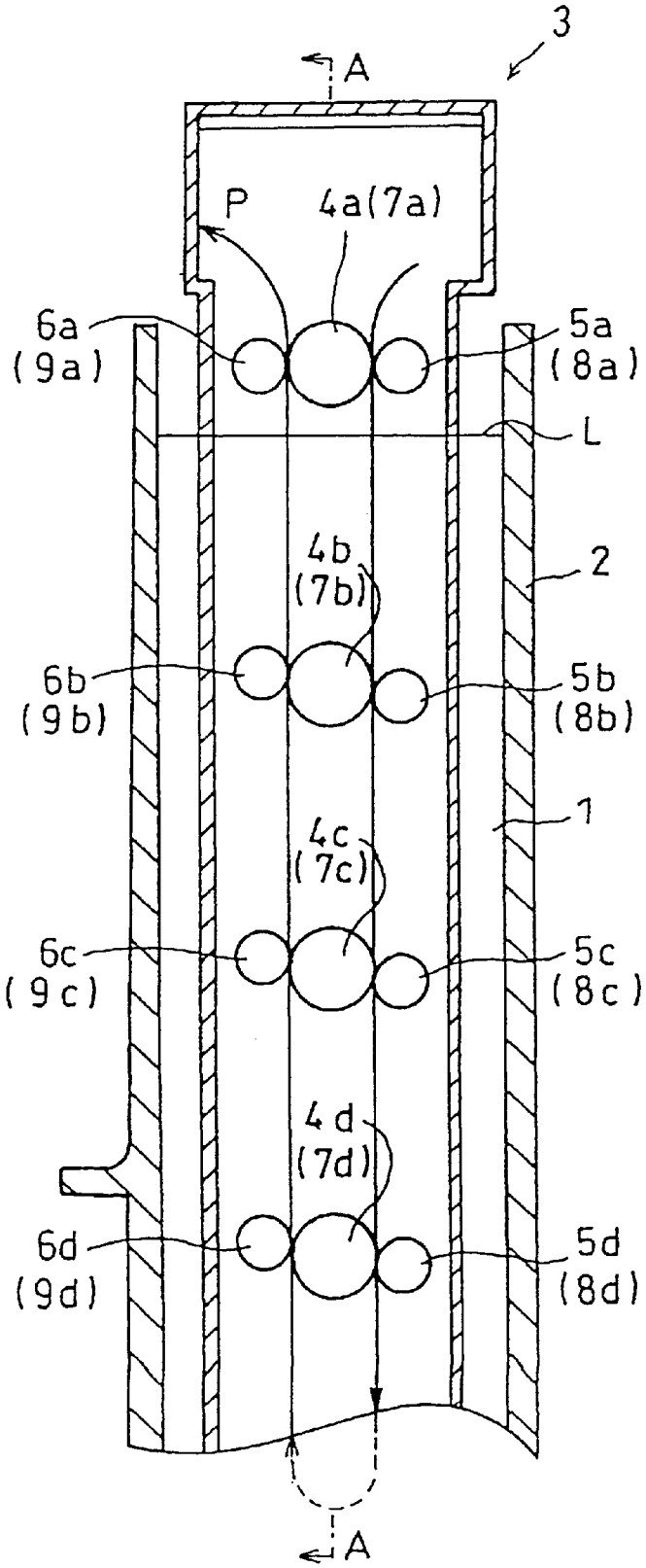
FIG. 2 is a cross sectional view showing an arrangement of transport rollers provided in the rack and a film transport path.

As shown in FIG. 2, the rack 3 includes large-diameter rollers 4*a*, 4*b*, 4*c*, 4*d*, first small-diameter rollers 5*a*, 5*b*, 5*c*, 5*d*, and second small-diameter rollers 6*a*, 6*b*, 6*c*, 6*d*, as transport rollers corresponding to the first transport path W shown in FIG. 1. In addition, the rack includes a pair of feed rollers (not shown) and reverse rollers (not shown). The respective rollers are all provided so that their axes of rotation are along the widthwise direction of the film and in parallel with the liquid surface L of the treatment liquid 1.

The pair of feed rollers introduce the film into the treatment tank 2, and are arranged so as to face each other near the film inlet (not shown) of the rack 3. On the other hand, reverse rollers are provided at the bottom and of the rack 3 without contacting any other roller, and the transport direction of the film being transported is reversed by being guided by the circumferential surfaces of the reverse rollers.

The large-diameter roller 4*a* is provided in an upper position inside the rack 3 so that the circumferential surface thereof is not brought into contact with the liquid surface L of the treatment liquid 1 in the treatment tank 2 by its rotation even if the rack 3 is set in the treatment tank 2. The large-diameter rollers 4*b*, 4*c*, 4*d* are provided in this order in a downward direction from the large-diameter roller 4*a* so that the intervals between successive rollers (excluding the interval between the large-diameter rollers 4*a* and 4*b*) are substantially equal and are completely immersed in the treatment liquid 1.

The first small-diameter rollers 5*a*, 5*b*, 5*c*, 5*d* are positioned so as to face the large-diameter rollers 4*a*, 4*b*, 4*c*, 4*d* to transport the film introduced by the pair of feed rollers by the rotation of the respective pairs of the large-diameter and small-diameter rollers while tightly holding the film.

The second small-diameter rollers 6*a*, 6*b*, 6*c*, 6*d* are positioned to face the large-diameter rollers 4*a*, 4*b*, 4*c*, 4*d* at the side opposite the first small-diameter rollers 5*a*, 5*b*, 5*c*, 5*d* so that the film, having its transport direction reversed by the reverse rollers, can be transported by the rotation of the respective pairs of large-diameter and small-diameter rollers while being tightly held.

As shown in FIG. 2, the rack 3 also includes large-diameter rollers 7*a*, 7*b*, 7*c*, 7*d*, first small-diameter rollers 8*a*, 8*a*, 8*c*, 8*d*, and second small-diameter rollers 9*a*, 9*b*, 9*c*, 9*d* as transport rollers corresponding to the second transport path W2 shown in FIG. 1, and a pair of feed rollers (not shown) and reverse rollers (not shown). The large-diameter rollers 7*a*, 7*b*, 7*c*, 7*d* and the large-diameter rollers 4*a*, 4*b*, 4*c*, 4*d* share rotatable shafts 30*a*, 30*b*, 30*c*, 30*d* (see FIG. 1), respectively. Further, the first small-diameter rollers and the second small-diameter rollers are provided coaxially with the first small-diameter rollers and the second small-diameter rollers, respectively. Likewise, the pair of feed rollers and the reverse rollers provided in the second transport path W2 are provided coaxially with the pair of feed rollers and the reverse roller provided in the first transport path W2, respectively.

Therefore, the large-diameter rollers and the first small-diameter rollers are arranged so as to face each other in order to transport the film introduced to the pair of feed rollers by the rotation of the respective pairs of the large-diameter rollers and the small-diameter rollers while tightly holding it. Further, the large-diameter rollers and the second small-diameter rollers are positioned to face each other, respectively at the opposite side from the first small-diameter rollers, in order to transport the film having its transport direction reversed by the reverse roller by the rotation of the respective pairs of the large-diameter rollers and the second small-diameter rollers while tightly holding it.

Next, the mechanism of the automatic developing apparatus for transmitting torque from a drive source (not shown) outside the treatment tank 2 to the respective transport rollers is described below.

As shown in FIG. 1, in the rack 3, a shaft 11 having an axis of rotation in parallel with the rotatable shaft 30*a* of the large-diameter rollers 4*a*, 7*a* is provided above the large-diameter rollers 4*a*, 7*a*. A gear 12 coaxially rotatable with the shaft 11 by the torque from the drive source is secured to one end of the shaft 11. At the end of the rotatable shaft 30*a* opposite the large-diameter roller 4*a* with respect to the large-diameter roller 7*a*, a first spur gear 13 is provided coaxially with the rollers 7*a*, 4*a*. This first spur gear 13 is in mesh with a second spur gear 14 which is coaxial with the shaft 11 and is secured in a position more inward than the gear 12 inside the rack 3.

A bevel gear 15 is provided coaxially with the rollers 4*a*, 7*a* at the side of the rotatable shaft 30*a* opposite the first spur gear 13. The first spur gear 13 and the bevel gear 15 are provided above the liquid surface L of the treatment liquid 1 so as not to scoop up the treatment liquid 1 by being brought into contact with the treatment liquid 1 in the treatment tank 2 while being rotated.

At the side of the rotatable shaft 30*b* of the large-diameter rollers 4*b*, 7*b* present below the liquid surface L of the treatment liquid 1, a bevel gear 16 is provided coaxially with these rollers 4*b*, 7*b* and on the side opposite the large-diameter roller 7*b* with respect to the large-diameter roller 4*b*. At the sides of the rotatable shafts 30*c*, 30*d* opposite the large-diameter rollers 7*c*, 7*d* with respect to the large-diameter rollers 4*c*, 4*d*, third spur gears 17*c*, 17*d* are provided coaxially with these rollers. Between the bevel gear 16 and the third spur gear 17*c*, and between the third spur gears 17*c*, 17*d*, fourth spur gears 18*a*, 18*c*, 18*d*, are provided in mesh with the corresponding ones of the gears 16, 17*c*, 17*d*, respectively.

Figure 3:
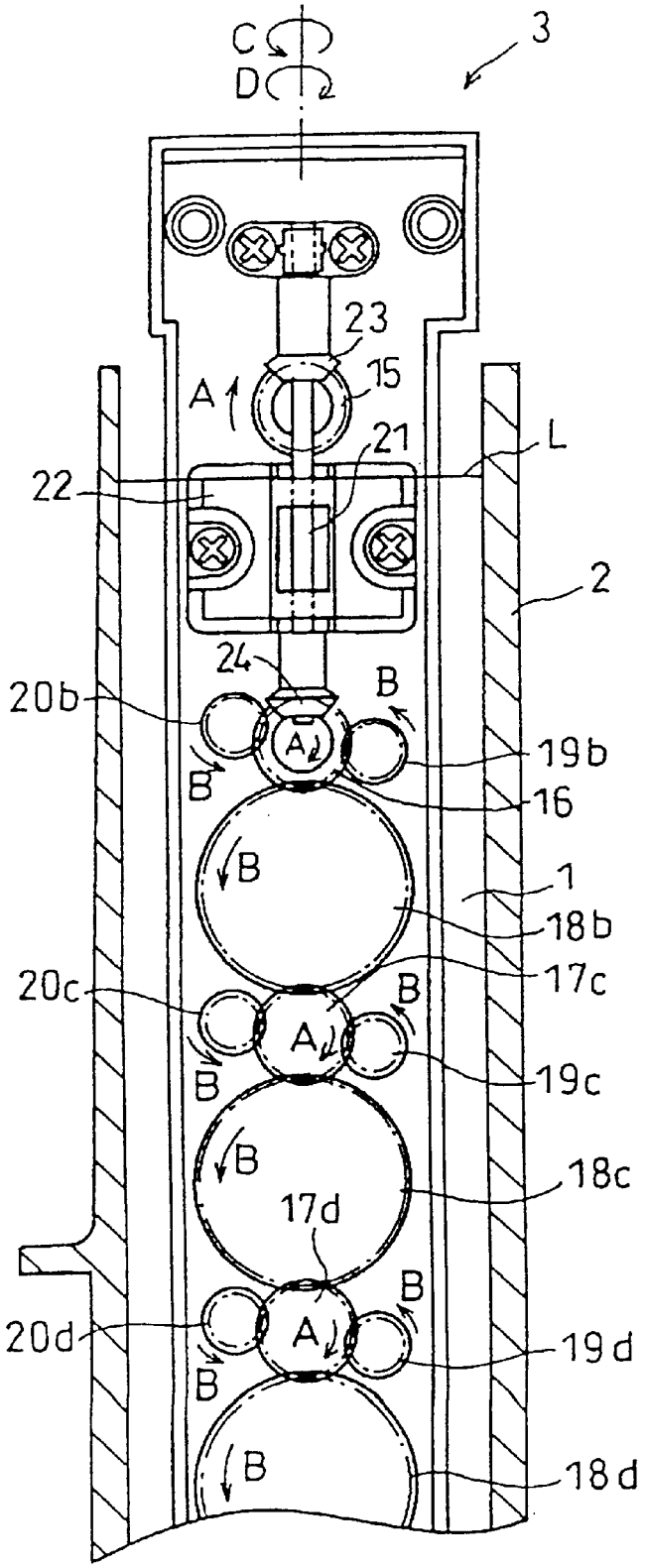
FIG. 3 is a cross sectional view showing gears and shafts provided coaxially with the respective transport rollers in the rack.
Figure 4:
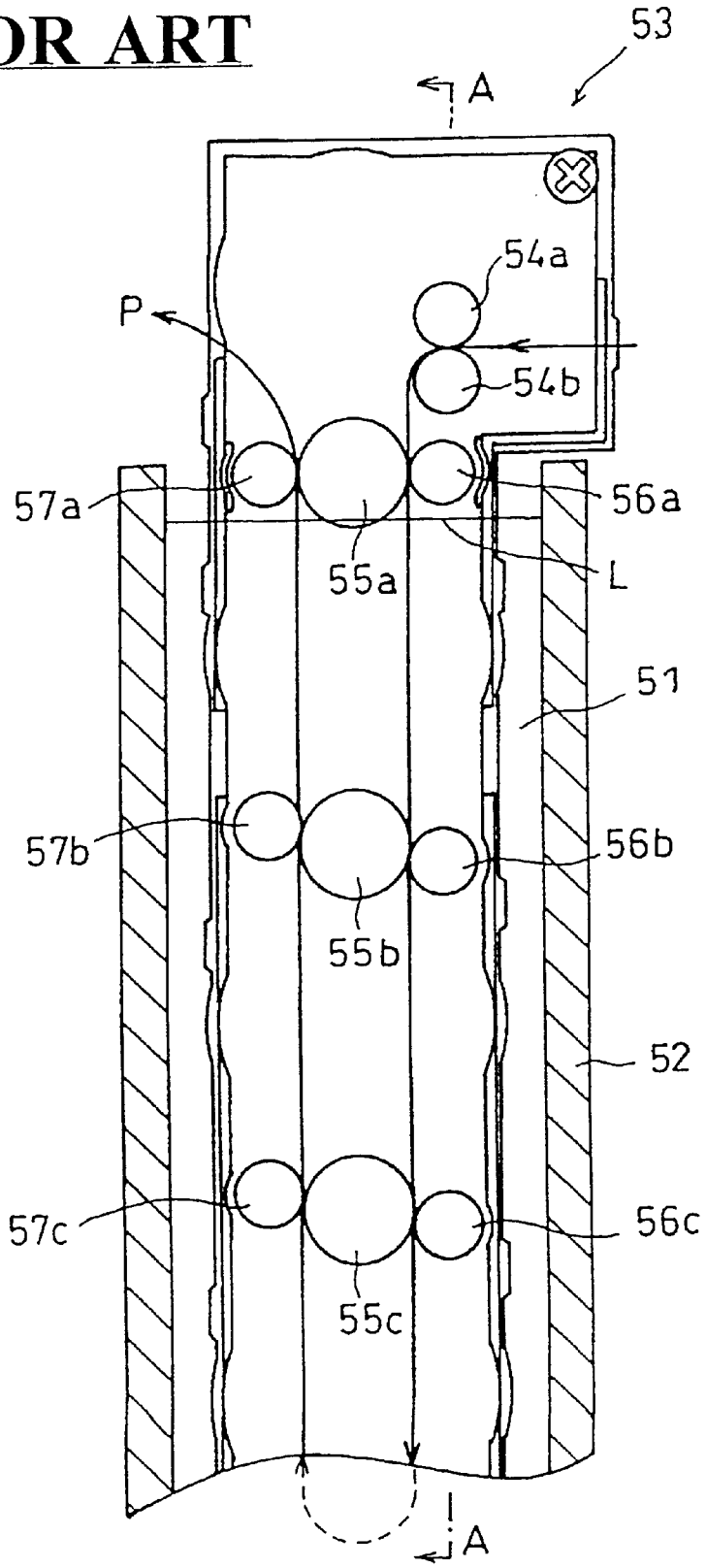
FIG. 4 PRIOR ART
FIG. 4 is a cross sectional view showing the structure of transport rollers and a film transport path provided in a rack of a conventional automatic developing apparatus.
Figure 5:
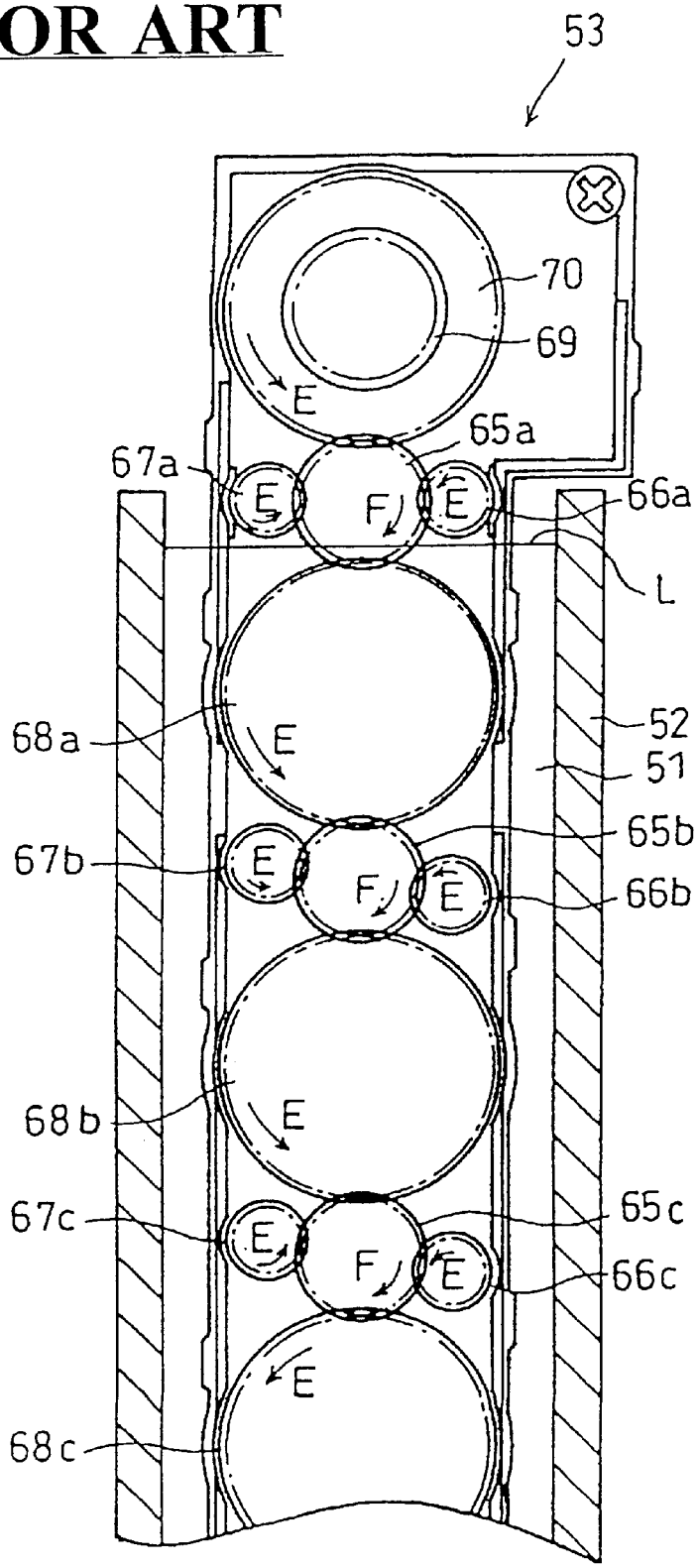
FIG. 5 PRIOR ART
FIG. 5 is a cross sectional view showing an arrangement of gears and shafts provided coaxially with the respective transport rollers in the rack of FIG. 4.
Figure 6:
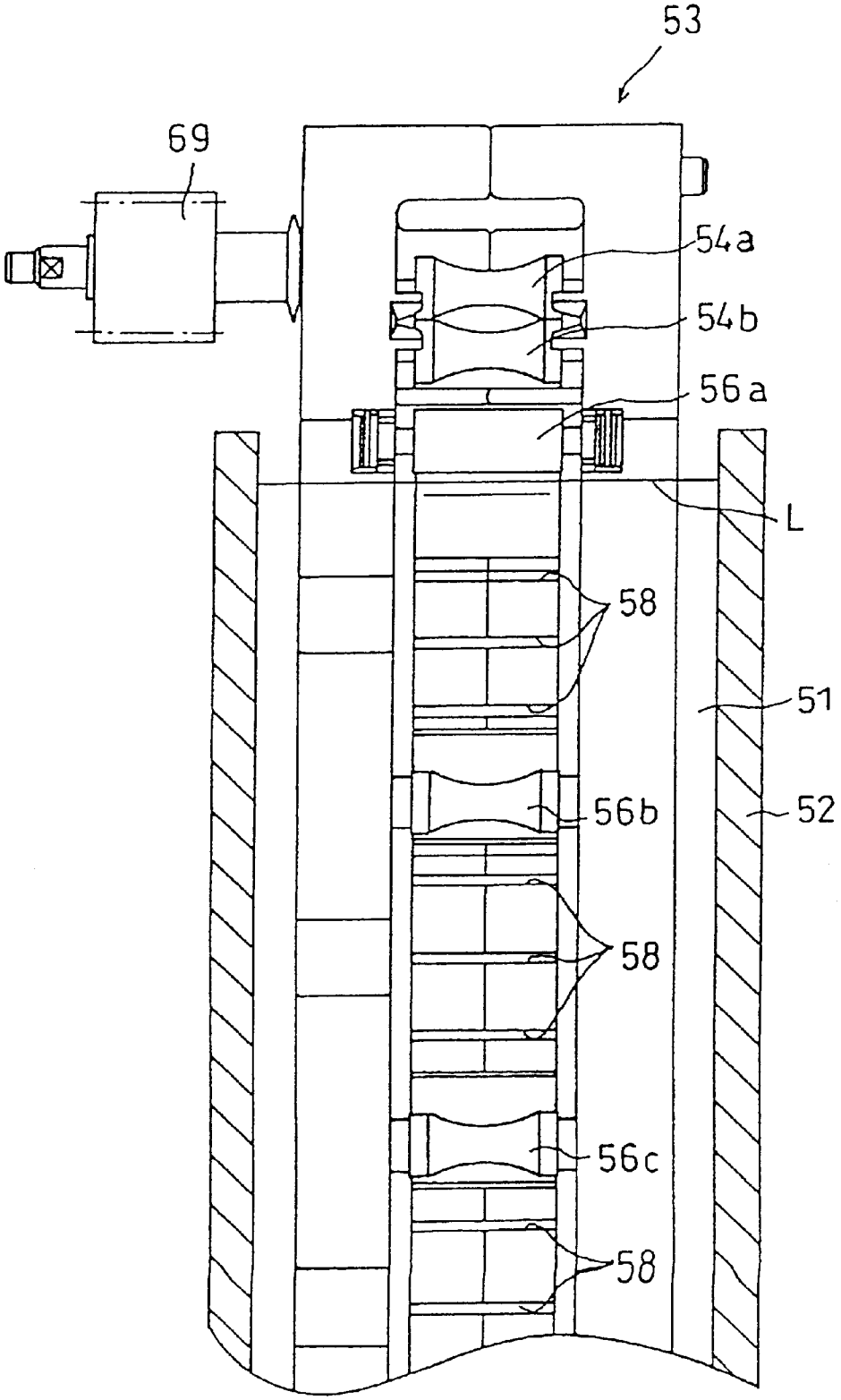
FIG. 6 PRIOR ART
FIG. 6 is a cross sectional view along line A—A of FIG. 4 showing the schematic inner construction of the rack of a conventional automatic developing apparatus.

At the sides of the respective rotatable shafts of the first small-diameter rollers 5*b*, 5*c*, 5*d* shown in FIG. 2 opposite the first small-diameter rollers 8*a*, 8*c*, 8*d* with respect to the first small diameter rollers 5*b*, 5*c*, 5*d*, fifth spur gears 19*b*, 19*c*, 19*d*, sharing the same rotatable shafts with these rollers are provided as shown in FIG. 3. The fifth spur gears 19*b*, 19*c*, 19*d* are present so as to be in mesh with the bevel gear 16, the third spur gears 17*c*, 17*d*, in this order, respectively.

At the sides of the respective rotatable shafts of the second small-diameter rollers 6*b*, 6*c*, 6*d*, shown in FIG. 2 opposite the second small-diameter rollers 9*b*, 9*c*, 9*d*, with respect to the first small-diameter rollers 6*b*, 6*c*, 6*d*, sixth spur gears 20*b*, 20*c*, 20*d*, sharing the same rotatable shafts with these rollers are provided, as shown in FIG. 3. The sixth spur gears 20*b*, 20*c*, 20*d*, are positioned so as to mesh with the bevel gear 16 and the third spur gears 17*c*, 17*d*, in this order at the opposite side from the fifth spur gears 19*b*, 19*c*, 19*d*, respectively.

At the side of the rotatable shaft of the first small-diameter roller 5*a* on the side opposite the first small-diameter roller 8*a* with respect to the first small-diameter roller 5*a* and at the side of the rotatable shaft of the second small-diameter roller 6*a* on the side opposite the second small-diameter roller 9*a* with respect to the second small-diameter 6*a*, spur gears (not shown) are provided which share the same rotatable shafts with the respective rollers and mesh with the bevel gear 16.

Spur gears are provided coaxially with the pair of feed rollers. However, the torque from the drive source is transmitted to the feed rollers at least via, e.g. the second spur gear 14 so that the respective feed rollers can introduce the film between the large-diameter roller 4*a* (7*a*) and the first small-diameter roller 5*a* (8*a*) by their rotation. Further, the respective reverse rollers are connected with the third spur gear located at a bottommost position in the rack 3 while sharing the same rotatable shaft therewith.

Next, the shaft drive of the present invention is described below. In this embodiment, torque is transmitted from the bevel gear 15 to the bevel gear 16 through the liquid surface L by means of a shaft having an axis of rotation which is normal to the liquid surface L.

Specifically, as shown in FIGS. 1 and 3, the rack 3 is provided with a cylindrical shaft 21 (shaft-shaped transmitting portion) having an axis of rotation normal to the liquid surface L of the treatment liquid 1. This shaft 21 is made of metal such as SUS (stainless steel) 316 or resin which is unlikely to be oxidized by the treatment liquid 21. The shaft is positioned so as to cross the liquid surface L of the treatment liquid 1. The shaft is supported by a shaft supporting member 22. A bevel gear 23 is secured coaxially with the shaft 21 in a position where shaft 21 is above the liquid surface L, whereas bevel gear 24 is secured coaxially with the shaft 21 when in a position below the liquid surface L. The bevel gear 23 is in mesh with the upper teeth portion 15*a* of the bevel gear 15 which is located above the rotatable shaft 30*a*, whereas the bevel gear 24 is in mesh with the upper teeth portion 16*a* of the bevel gear 16 which is located above the rotatable shaft 30*b*.

Unlike the conventional apparatus, the construction according to this embodiment for transmitting torque from the outside of the treatment tank 2 to the bevel gears and spur gears arranged below the liquid surface L through the liquid surface L of the treatment liquid 1 is not such that a torque transmitting member, such as a gear located in the vicinity of the liquid surface L and having an axis of rotation in parallel with the liquid surface L is brought into contact with the liquid surface L of the treatment liquid 1. Instead, the torque of the bevel gear 15 located above the liquid surface L and having an axis of rotation parallel with the liquid surface L is translated into the torque of the shaft 21 having the axis of rotation normal to the liquid surface L, which is then transmitted to the bevel gear 16 located below the liquid surface L and having an axis of rotation in parallel with the liquid surface L. In such a construction, the treatment liquid 1 will not be scooped up since the shaft 21 in contact with the liquid surface L of the treatment liquid 1 is rotated above the axis of rotation normal to the liquid surface L.

As described above, in this embodiment, the torque transmitting means for transmitting torque from the drive source outside the treatment tank 2 to the respective transport rollers is composed of the respective shafts, gears, spur gears, rotatable shafts and bevel gears.

Further, the rack 3 further includes slit-shaped discharge ports 10*a* for discharging the treatment liquid 1 toward the film being transported along the first transport path W1 and introducing it into the treatment tank 2, and slit-shaped discharge ports 10*b* for discharging the treatment liquid 1 toward the film being transported along the second transport path W2 and admitting it into the treatment tank 2. Opening areas of the respective discharge ports 10*a*, 10*b* correspond to the widths of the corresponding films.

The automatic developing apparatus according to this embodiment is provided with a heater (not shown) for heating the treatment liquid 1 to a suitable temperature and a pump (not shown) for circulating the treatment liquid 1 heated by the heater between the inside and outside of the treatment tank 2. With this construction, the temperature of the treatment liquid 1 in the treatment tank 2 can be constantly maintained at a temperature suited for film development.

Next, the operation of the automatic developing apparatus having the above torque transmitting means is described. In the description below, the rotating directions of the respective shafts, gears, spur gears and bevel gears are defined as follows for the sake of convenience. Specifically, in FIG. 3, for those having the axes of rotation in parallel with the liquid surface L of the treatment liquid 1, A, B denote clockwise and counterclockwise directions about the respective axes of rotation, respectively. On the other hand, for those having the axes of rotation normal to the liquid surface L of the treatment liquid 1, when the thumb of the right hand points downward along the axis of rotation, the remaining four fingers point in the direction C, and D is the rotating direction opposite the rotating direction C. It is further assumed that the respective rotating directions in FIGS. 1 and 2 correspond to those in FIG. 3.

In the above construction, when torque is transmitted from the drive source to the gear 12 in FIG. 1, thereby causing the gear 12 to rotate, e.g. in the direction B shown in FIG. 1, the shaft 11 and the second spur gear 14 are likewise rotated in the direction B in synchronization with the gear 12. Accordingly, the first spur gear 13 in mesh with the second spur gear 14, and the bevel gear 15 provided coaxially with the first spur gear 13 are rotated in the direction A.

Then, the bevel gear 23 in mesh with the upper teeth portion 15*a* of the bevel gear 15 is rotated in the direction C in FIG. 1. The result is that the shaft 21 and the bevel gear 24 provided coaxially with the bevel gear 23 are likewise rotated in the direction C, and the bevel gear 16 having the upper teeth portion 16*a* in mesh with the bevel gear 24 is rotated in the direction A.

Since the shaft 21 is rotated about the axis of rotation which is normal to the liquid surface L of the treatment liquid 1, the torque of the bevel gear 15 is transmitted to the bevel gear 16 via the bevel gear 23, the shaft 21 and the bevel gear 24 without scooping up the treatment liquid 1 during the rotation of the shaft 21.

If the bevel gear 16 is rotated in the direction A, the fifth spur gear 19*b*, the sixth spur gear 20*b* and the fourth spur gear 18*a* which are in mesh with the bevel gear 16 as shown in FIG. 3 are rotated in the direction B. The rotation of the fourth spur gear 18*a* in the direction B causes the third spur gear 17*c* in mesh with the fourth spur gear 18*a* to rotate in the direction A.

Similarly, the fifth spur gears, the sixth spur gears, and the fourth spur gears are rotated in the direction B. The third spur gears, in mesh with the fourth spur gears, are rotated in the direction A.

Accordingly, the large-diameter rollers 4*a* (large-diameter rollers 7*a*) and the reverse rollers provided coaxially with the bevel gears 15, 16 and the third spur gears 17*b*, 17*c* are all rotated in the direction A. However, the first small-diameter rollers 5*b* (first small-diameter roller 8*a*) provided coaxially with the fifth spur gears 19*b*, and the second small-diameter rollers 6*b* (second small-diameter rollers 9*b*) provided coaxially with the sixth spur gears 20*b*, are all rotated in the direction B.

Thus, in FIG. 2, film having a width of 24 mm which has passed between the film inlet (not shown) and the feed rollers is transported downward while successively passing between the corresponding pairs of the large-diameter rollers 4 and the first small-diameter rollers 5. After having its transport direction reversed from downward to upward by the reverse rollers, the film is transported upward from the bottom while passing successively between the corresponding pairs of the large-diameter rollers 4 and the second small-diameter rollers 6. Thereafter, the film is transported to the next treatment tank 2 after passing between the large-diameter roller 4*a* and the second small-diameter roller 6*a*.

On the other hand, film having a width of 35 mm is transported downward while successively passing between corresponding pairs of the large-diameter rollers 7 and the first small-diameter rollers 8. Then its transport direction is reversed from downward to upward by the reverse rollers, and the film is then transported upward from the bottom while passing successively between the corresponding pairs of the large-diameter rollers 7 and the second small-diameter rollers 9. Finally, the film is transported to the next treatment tank 2 after passing between the large-diameter roller 7*a* and the second small-diameter roller 9*a*. Thus, the film passes along a film transport path indicated by an arrow P in FIG. 2.

As described above, in transmitting torque from the outside of the treatment tank 2 to the respective transport rollers through the liquid surface L of the treatment liquid 1, the shaft 21 is positioned where it can contact the liquid surface L, and torque is transmitted from above the liquid surface to below the liquid surface L by means of this shaft 21. Since shaft 21 is rotated about the axis of rotation which is normal to the liquid surface L, the treatment liquid 1 in contact with the shaft 21 is left in contact with the shaft 21 at a specified height even if shaft 21 is rotated. Accordingly, the rotation of the shaft 21 does not cause the treatment liquid 1 to be passed up onto, e.g. the bevel gears 23, 15 located above the liquid surface L via the shaft 21. Therefore, the treatment liquid 1 will not solidify on the bevel gears 23, 15. Thus, torque can be smoothly transmitted to the respective transport rollers via the liquid surface L without causing any encumbrance on the rotation of the bevel gears 23, 15.

Further, since the liquid treatment 1 near the liquid surface L will not be scooped up even if the shaft 21 is rotated, oxidization and evaporation of the treatment liquid 1 can be considerably restrained. As a result, a reduction in the function of the treatment liquid 1 and a decrease in the quantity thereof can be prevented. Therefore, even when using the treatment liquid 1, which is specified to be used in a small quantity and thus is more likely to be influenced by oxidation, satisfactory development can still be achieved. Further, since a reduction in the function of the treatment liquid 1 is prevented, it becomes easier to control the quality of the treatment liquid 1.

Although the shaft 21 having an axis of rotation normal to the surface L has a cylindrical shape in this embodiment, the shape thereof is not particularly limited, provided that it has an axis of rotation normal to the liquid surface L. For example, the shaft 21 may be in the shape of a polygonal prism, a cone, or an inverted cone. In such a case, the same effects as described above can be obtained since the shaft 21 will not scoop up the treatment liquid 1 while being rotated.

However, if the shaft 21 has a cylindrical shape as in this embodiment, the cross section of the shaft 21 in the liquid surface L does not change regardless of whether the shaft 21 is stationary or rotating. Thus, as compared to where the shaft 21 is in the shape of a polygonal prism, the liquid surface L is unlikely to be rippled. Accordingly, there is little likelihood that the treatment liquid 1 will be mixed with air by the rotation of the shaft 21. Therefore, when the shaft 21 has a cylindrical shape, oxidation of the treatment liquid 1 can be considerably slowed down as compared to where it has any other shape. As a result, the treatment liquid 1 can be used for a longer period of time while avoiding a reduction in its quality.

If the shaft 21 has a shape of, e.g. a polygonal prism, the treatment liquid 1 acts as a load on the respective side surfaces of the shaft 21 during the rotation of the shaft 21. However, if the shaft 21 has a cylindrical shape, such loads can be considerably reduced. As a result, the torque can be more satisfactorily transmitted by smoothly rotating the shaft 21.

Although the surface of the shaft 21 is even in this embodiment, it may be made uneven, e.g. by forming grooves therein in order to further avoid the treatment liquid 1 being rippled during the rotation of the shaft 21.

Although the torque is successively transmitted to the respective transport rollers located below the liquid surface L of the treatment liquid 1 via the spur gears in this embodiment, the invention is not limited to this torque transmitting arrangement. For example, the invention may be applied to an embodiment which torque is transmitted to the respective transport rollers via a belt mechanism, a crank mechanism or a cam mechanism.

As described above, the automatic developing apparatus of the present invention is provided with a torque transmitting means for transmitting torque from the outside of the treatment tank to the respective transport rollers via the liquid surface of the treatment liquid. The torque transmitting means is composed of a shaft-shaped transmitting portion having an axis of rotation normal to the liquid surface. The shaft-shaped transmitting portion is arranged so as to cross the liquid surface, whereas the remaining portion of the torque transmitting means is arranged so as not to cross the liquid surface.

Accordingly, the treatment liquid in contact with the shaft-shaped transmitting portion is left in contact therewith at a specified height, and there is no opportunity for the treatment liquid to be passed up onto the torque transmitting means located above the liquid surface via the shaft-shaped transmitting portion by the rotation of the shaft-shaped transmitting portion. Thus, unlike the conventional apparatus, the drive of the torque transmitting means will not be hindered by the solidification of treatment liquid thereon. According to the above construction, torque can be smoothly transmitted from the outside of the treatment tank to the respective transport rollers via the liquid surface of the treatment liquid without depositing superfluous material. As a result, the film can be satisfactorily transported.

Further, the treatment liquid near the liquid surface will not be scooped up during the rotation of the shaft-shaped transmitting portion. This prevents the reaction of the treatment liquid with air to a large degree. As a result, oxidation and evaporation of the treatment liquid are limited. Therefore, according to the above construction, a reduction in the function of the treatment liquid and a decrease in the quantity of the treatment liquid can be reliably prevented, and satisfactory development in accordance with the specifications of the treatment liquid can be attained.

If the shaft-shaped transmitting portion is formed with a cylindrical shape, the liquid surface is unlikely to be rippled, and there is little likelihood that the treatment liquid will be mixed with air by the rotation of the shaft-shaped transmitting portion as compared to where the shaft-shaped transmitting portion is in the shape of, e.g. a polygonal prism. As a result, oxidation and evaporation of the treatment liquid can be considerably slowed down, and the treatment liquid can be used for a longer period of time while avoiding a reduction in its quality.

The Japanese priority application No. 10-028975 is specifically incorporated herein by reference.

What is claimed is:

1. An automatic developing apparatus comprising:

a treatment tank for holding a treatment liquid having a liquid surface and for developing a photosensitive material;

a transport unit disposed in said treatment tank, said transport unit comprising a plurality of transport rollers for transporting the photosensitive material and a torque transferring means for transferring torque from one of said plurality of transport rollers to the other of said plurality of transport rollers;

a torque transmitting means for transmitting torque from outside of the treatment tank to said transport rollers through the liquid surface in the treatment tank, said torque transmitting means comprising a shaft-shaped transmitting portion having an axis of rotation normal to the liquid surface, wherein a portion of said shaft-shaped transmitting portion is positioned so as to extend into the treatment liquid and wherein said torque transferring means has an axis of rotation in a direction other than that normal to the liquid surface and all components of said transferring means are located below the liquid surface.

2. An automatic developing apparatus according to claim 1, wherein said portion of said shaft-shaped transmitting portion has a cylindrical shape.

3. An automatic developing apparatus according to claim 1, wherein said torque transmitting means further comprises a first rotatable shaft above the liquid surface and at least one second rotatable shaft below the liquid surface, said first and second shafts are parallel with the liquid surface and each being connected to said shaft-shaped transmitting portion by torque transmission gears.

4. An automatic developing apparatus according to claim 1, wherein said torque transferring means has an axis of rotation parallel with that of said transport rollers.

5. An automatic developing apparatus according to claim 1, wherein said torque transferring means comprises a plurality of spur gears that mesh with each other and each of said spur gears rotates about an axis of rotation parallel with that of said transport rollers.

6. An automatic developing apparatus comprising:

a treatment tank for holding a treatment liquid having a liquid surface and for developing a photosensitive material;

a transport unit disposed in said treatment tank, said transport unit comprising a plurality of transport rollers for transporting the photosensitive material and a torque transferring unit located below the liquid surface and configured to transfer torque from one of said plurality of transport rollers to the other of said plurality of transport rollers;

a torque transmitting shaft for transmitting torque from outside of the treatment tank to said transport rollers through the liquid surface in the treatment tank, said torque transmitting shaft being disposed normal to the treatment liquid surface and positioned so as to extend into the treatment liquid and wherein said torque transferring unit has an axis of rotation in a direction other than that normal to the liquid surface.

7. An automatic developing apparatus according to claim 6, wherein said torque transmitting shaft has a cylindrical shape.

8. An automatic developing apparatus according to claim 6, further comprising a first rotatable shaft above the liquid surface and at least one second rotatable shaft below the liquid surface, said first and second shafts are parallel with the liquid surface and each being connected to said torque transmitting shaft by torque transmission gears.

9. An automatic developing apparatus according to claim 6, wherein said torque transferring unit comprises gears having axes of rotation parallel with those of said transport rollers.

10. An automatic developing apparatus according to claim 6, wherein said torque transferring unit comprises a plurality of spur gears that mesh with each other and each of said spur gears rotates about an axis of rotation parallel with those of said transport rollers.

* * * * *